United States Patent [19]

Carr

[11] 4,099,591

[45] Jul. 11, 1978

[54] VEHICLE CONTROL SCANNING SYSTEM

[75] Inventor: Frank J. Carr, Annapolis, Md.

[73] Assignee: Westinghouse Electric Corp., Pittsburgh, Pa.

[21] Appl. No.: 720,026

[22] Filed: Sep. 2, 1976

[51] Int. Cl.[2] ..... G08G 1/12

[52] U.S. Cl. ..... 180/98; 250/568; 340/23

[58] Field of Search ..... 180/98; 250/566, 568; 343/5; 340/23

[56] References Cited

U.S. PATENT DOCUMENTS

| | | | |
|---|---|---|---|
| 3,172,496 | 3/1965 | Rabinow et al. | 180/98 X |
| 3,697,941 | 10/1972 | Christ | 340/23 |
| 3,815,084 | 6/1974 | Pease | 340/23 |
| 3,928,759 | 12/1975 | Sansone | 250/568 |
| 3,940,630 | 2/1976 | Bergonm | 250/568 |

OTHER PUBLICATIONS

Traffic Engineering and Control, Dec. 1970, p. 410.

*Primary Examiner*—Joseph F. Peters, Jr.
*Assistant Examiner*—Terrance L. Siemens
*Attorney, Agent, or Firm*—D. Schron

[57] ABSTRACT

A system wherein coded signposts on both sides of a vehicle's path are scanned during the course of travel of the vehicle. Scanning out both sides of the vehicle is accomplished with a single light source in conjunction with a mirror system including a multi-faceted rotating mirror, and detection of the signposts on either side of the vehicle is accomplished with the provision of a single detector and single signal processor.

9 Claims, 9 Drawing Figures

VEHICLE CONTROL SCANNING SYSTEM

BACKGROUND OF THE INVENTION

1. Field of the Invention

The invention in general relates to vehicle monitoring or control systems and particularly to an optical scanning system therefor.

2. Description of the Prior Art

A wide variety of traffic control or monitoring systems exists wherein the location of a vehicle is continuously reported to a central location during the course of travel of the vehicle. Such systems satisfy the needs of a municipality with regards to bus transit, police operations, fire departments, taxis, trucking, and municipal services.

Existing or proposed vehicle location systems include radio navigation systems, dead reckoning systems, and signpost systems. Signposts are classified as active when they are powered, and continuously emit a recognition signal irrespective of the absence or presence of a vehicle which can read the signal. Signposts are classified as passive when they emit a recognition signal only when triggered by an initiating signal emitted by a nearby vehicle. Due to the initally lower installation and maintenance cost, the passive signpost system appears to be an attractive approach. In one proposed passive system such as described in *Traffic Engineering & Control,* December 1970 beginning at page 410, an optical scanner is mounted on the vehicle and a beam of light projected out one side of the vehicle vertically scans a uniquely coded signpost generally consisting of a series of reflecting and non-reflecting bars arranged in a vertical sequence. The return light beam is thus modulated in accordance with the coded signpost and this information is detected and transmitted to a central location.

In another system such as illustrated in U.S. Pat. No. 3,940,630, scanning of a coded signpost is accomplished by movement of the vehicle. The arrangement produces a fan-shaped beam which reads a horizontally oriented coded signpost as the vehicle moves past it.

Since a wide variety of vehicles normally exist on a crowded city street, the optical beam, whether it is a horizontally moving fan-shaped beam or a vertically scanning narrow beam may be unable to read a particular signpost if a vehicle of greater height is blocking the optical path. It is conceivable, particularly on crowded streets, that the blockage may occur for several successive signposts. With this situation, or if the vehicle fails to read a signpost immediately after a turn, an objectionable error is introduced and built-up until a subsequent signpost can be successfully read.

In the present invention, the scanning system can read signposts that are positioned on both the right and left-hand sides of the street and the redundancy thus built into the system, along with the use of an odometer to measure the distance traveled from the last signpost, minimizes the impact of the problem. Further, in northern areas which receive snow, the situation may occur wherein a driving snow at a certain angle will completely cover the coded signposts on one and only one side of the street to render them unreadable. In such situations, the present apparatus will still provide adequate readings for system operation. The scanning and reading of signposts on both sides of the vehicle's path also insures for a more accurate system in the presence of damaged or missing signposts.

SUMMARY OF THE INVENTION

The system of the present invention includes a network of reflective target members disposed along the expectant path of the vehicle and on both sides of the path. An optical scanner is mounted on the vehicle and is operative to scan out both sides of the vehicle to read the target members on both sides of the path during travel of the vehicle and is operable to detect and decode the reflected optical beam.

In order to reduce hardware costs, the scanning mechanism includes a single source of energy in the form of a light beam and a single detector and signal processor in conjunction with a stationary mirror arrangement and a multifaceted rotating mirror.

BRIEF DESCRIPTION OF THE PREFERRED EMBODIMENT

Figure 1:
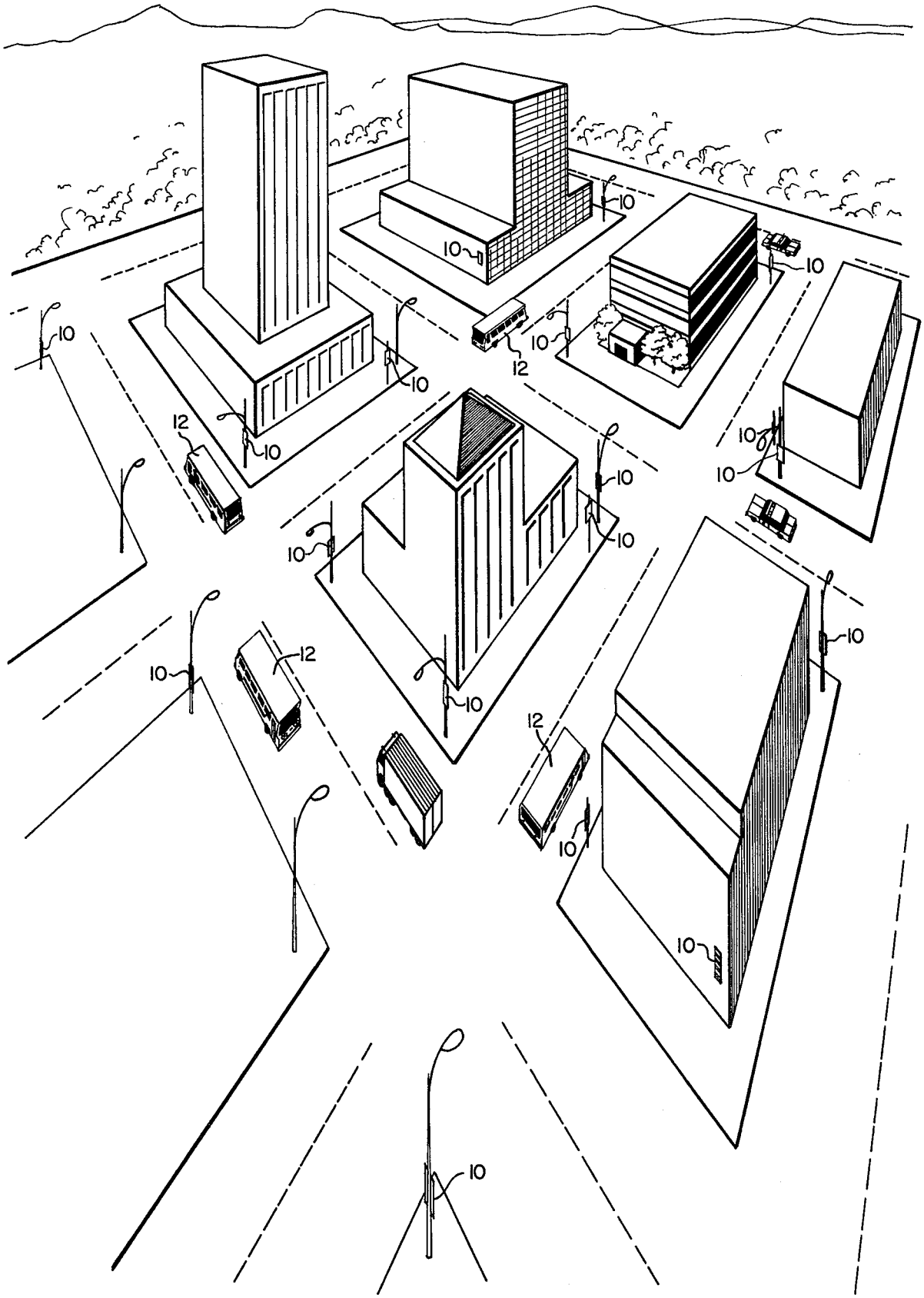
FIG. 1 illustrates a street scene of vehicular traffic and includes a network of reflective targets in the form of coded signposts.

The street scene of FIG. 1 illustrates a network of reflective target members 10 in the form of coded signposts positioned at predetermined locations along the expected path of monitored vehicles such as busses 12, and on either side of the vehicle's path. The signposts are uniquely coded for a particular location and the code, signpost location, and distances between the signposts may all be recorded along with the particular bus' identification and route, in a computer at a central location in communication with the bus.

Figure 2:
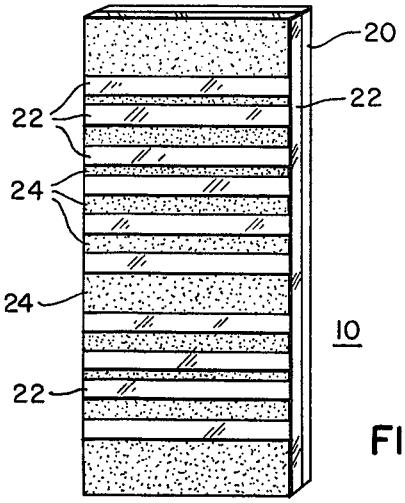
FIG. 2 illustrates one such signpost.

The signposts may be mounted on lighting standards, traffic sign supports, utility poles, buildings and by way of example a typical signpost is illustrated in FIG. 2. The signpost 10 is vertically oriented to be scanned by a vertically scanning beam and the dimensions are governed by a number of factors such as maximum expected speed of the monitored vehicle.

The fabrication is accomplished with state of the art materials and includes a substrate 20 which may for example be plastic or metal and onto which is affixed a reflective material in the form of a retroflective sheet 22, one example of which is known as SCOTCH LIGHT high intensity retroflective sheeting, a product of the 3M Company. The sign is given a bar code by affixing non-retroflective areas 24, such as by painting directly over the retroflective sheet 22. One requirement of the bar code is that it be read in either direction and be such that the direction of scanning can be determined by the decoder. One example of a bar code which may be utilized is the well known universal product code the interpretive technology of which is extremely well developed. Although not shown, a clear protective layer may be placed over the entire face of the assembly.

In a typical situation where the signposts are to be read not only by busses but by police cars as well, a maximum speed to be encountered passing the signpost by the police car may be in the order of 100 miles per hour (160.9 kilometers per hour). If the expected range of the vehicle-mounted scanner from the signposts is from 7 to 75 feet (2.13 to 22.86 meters) and if it has a scanning rate of 290 Hz then a typical signpost will have dimensions of 36 by 10 inches (91 by 25 centimeters). With these parameters there will be 1.65 signpost scans by the scanning beam at maximum vehicle speed. Lower speeds and shorter distances could permit utilization of signposts 27 by 6 inches (68 by 15 centimeters) which would reduce the material cost by 55%.

Figure 3:
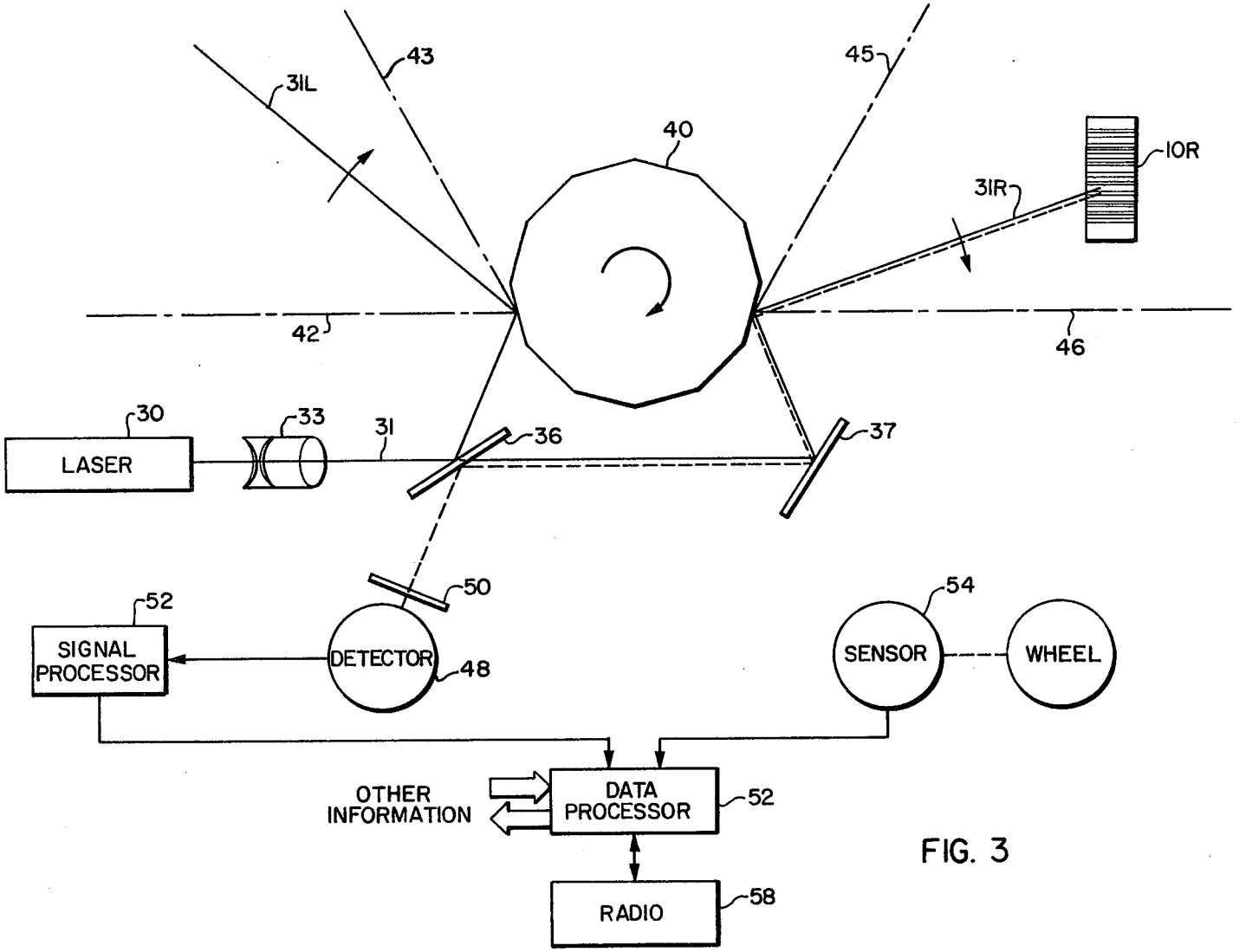
FIGS. 3 and 4 illustrate an embodiment of the present invention for scanning out both sides of the carrier vehicle, FIG. 3 illustrating a return from a right signpost and FIG. 4 illustrating a return from a left signpost.
Figure 4:
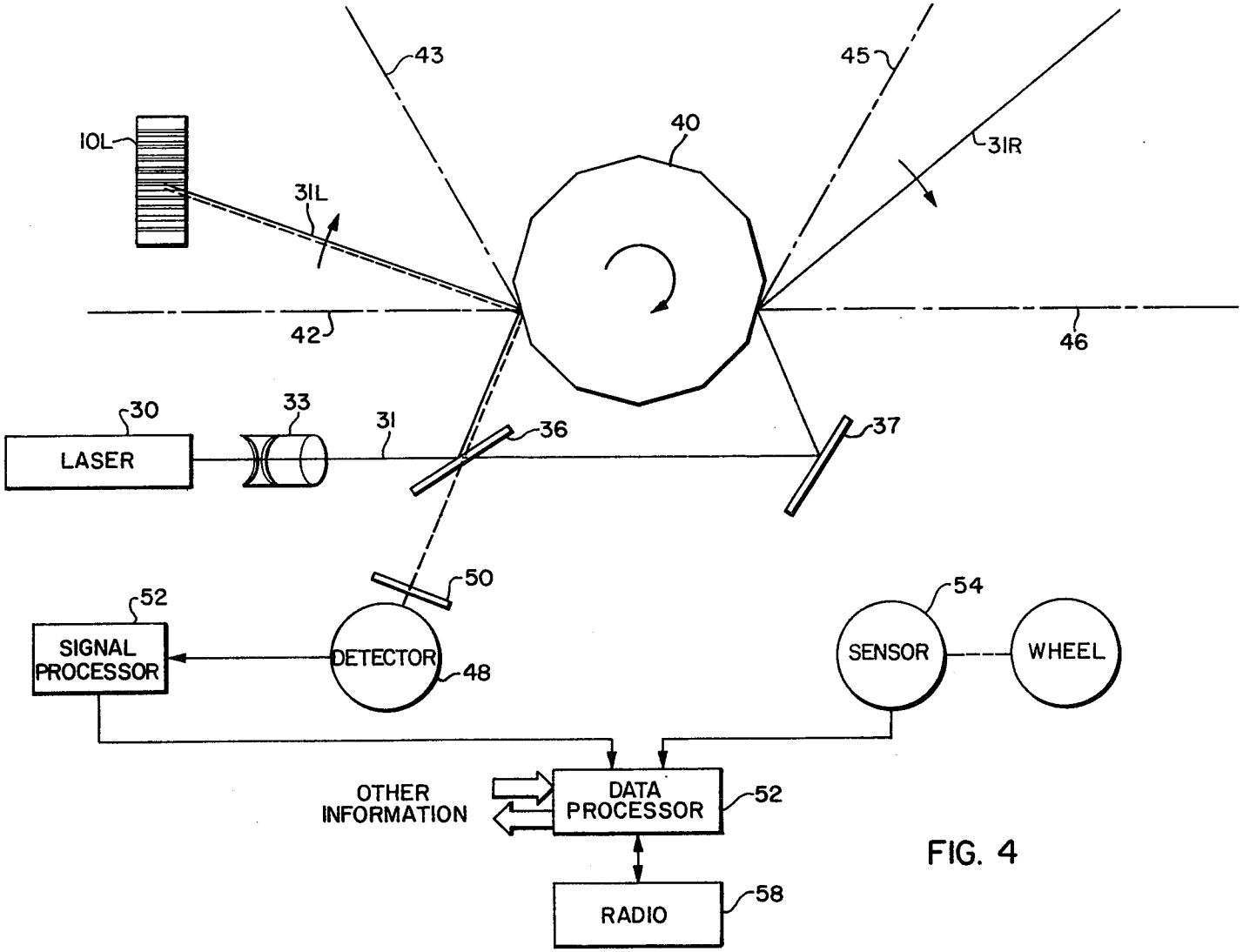

FIGS. 3 and 4 illustrate a preferred embodiment of the scanning apparatus for optically scanning coded signposts on both sides of the vehicle's path. The system utilizes an energy source such as the high intensity light of a low power laser 30 which projects a beam of light 31 through a lens system 33.

Disposed in the path of the light beam 31 are two mirrors 36 and 37, mirror 37 being 100% reflective while mirror 36 is of the beam splitter variety allowing 50% of the light to be reflective and 50% to be transmitted therethrough.

The scanning system includes a multi-faced rotating prism or mirror 40 which causes the light beam reflected from mirror 36 to scan from horizontal line 42 to angular scan limit 43, and causes the beam reflected from mirror 37 to scan from angular scan limit 45 to the horizontal 46. The orientation of the apparatus is such that the scanning beam from mirror 36 scans from the bottom to the top of the signpost while the scanning beam from mirror 37 scans from the top to the bottom of the signpost, with FIG. 3 illustrating the beam in the process of scanning a right signpost 10R.

The return beam, shown dotted, from signpost 10R is reflected back to detector 48 by the path which includes the facet of rotating mirror 40, mirror 37, and mirror 36. In order to filter unwanted optical radiation from the return signal to prevent saturation of the detector, an interference filter 50 is interposed in the return optical path.

A signal processor 52 similar to those used in reading the universal product code is provided and determines the identification of a valid code word. It decodes this word at high speeds and passes the decoded signal to an onboard data processor 52 which among other things compares the results of the scan with the results of a previous scan to determine whether the same or a different number has been provided. Data processor 52 also receives an input from odometer or wheel turn sensor 54 and other various inputs such as passenger counts, data from an onboard informational panel, as well as various other bits of information that must be transmitted to a central location by means of radio 58, which also receives instructions from that central location.

With the parameters previously given, a vehicle traveling at 100 miles per hour will pass a 10 inch sign in 5.68 milliseconds so that a scan rate of 290 hertz is required to insure the 1.65 scans of the signpost. The twelve-sided rotating mirror produces 12 scans per revolution so that a 1,452 RPM driver motor (not shown) is required for the scanning mirror. A 12-sided mirror also produces a predetermined scan angle between the horizontal and the angular scan limit of 60° although larger or smaller scan angles may of course be provided. FIG. 4 is identical to FIG. 3 except that in FIG. 4 the left scanning beam is reading a signpost 10L whereas the right scanning beam is not reading any target. The return beam, shown by dotted lines, reflects off the facet of the rotating mirror 40, is projected through mirror 36, and is sensed by detector 48 after passage through filter 50.

Detector 48 may be any one of a number of varieties of detectors however one that provides a highly satisfactory output in response to the reception of return optical energy of a helium-neon laser, which is the preferred light source, is a photo multiplier produced by RCA and having the designation C31043A.

Figure 5:
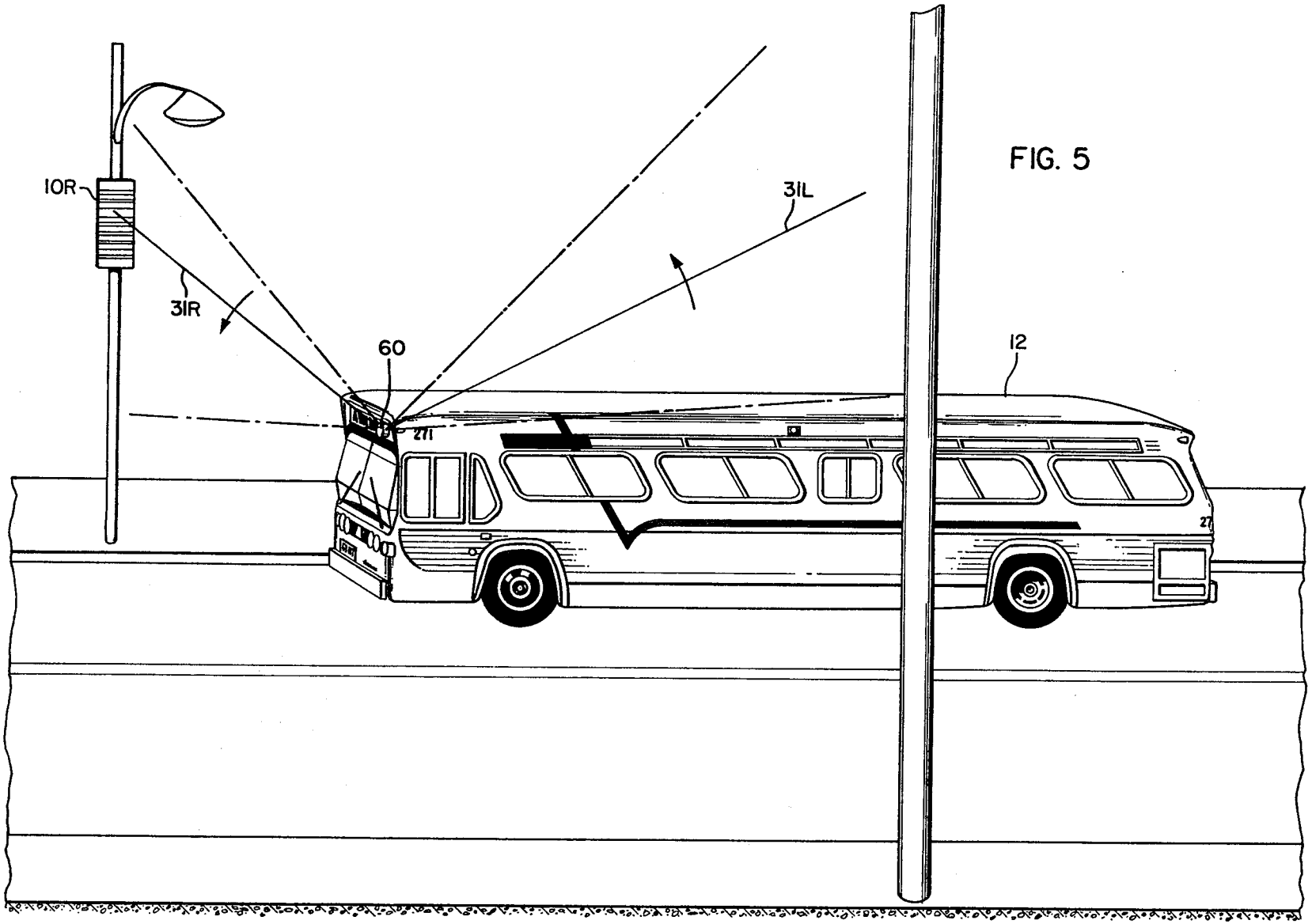
FIG. 5 illustrates a transit vehicle with the apparatus of the present invention installed.

FIG. 5 illustrates a bus 12 enroute, with the apparatus of the present invention forming two scanning beams 31R and 31L respectively scanning to the right and left sides of the bus' path, with the right scanning beam reading a coded signpost 10R.

The apparatus may be mounted at any convenient place on the bus so that scanning to both sides may be accomplished, and FIG. 5 illustrates the scanning apparatus as being contained in a housing 60 mounted on the upper part of the front of the bus. In this respect, although FIG. 4 shows two mirrors 36 and 37, the arrangement may include additional mirrors so that the laser 30 and associated lens system 33 may be positioned at a convenient location.

Figure 6:
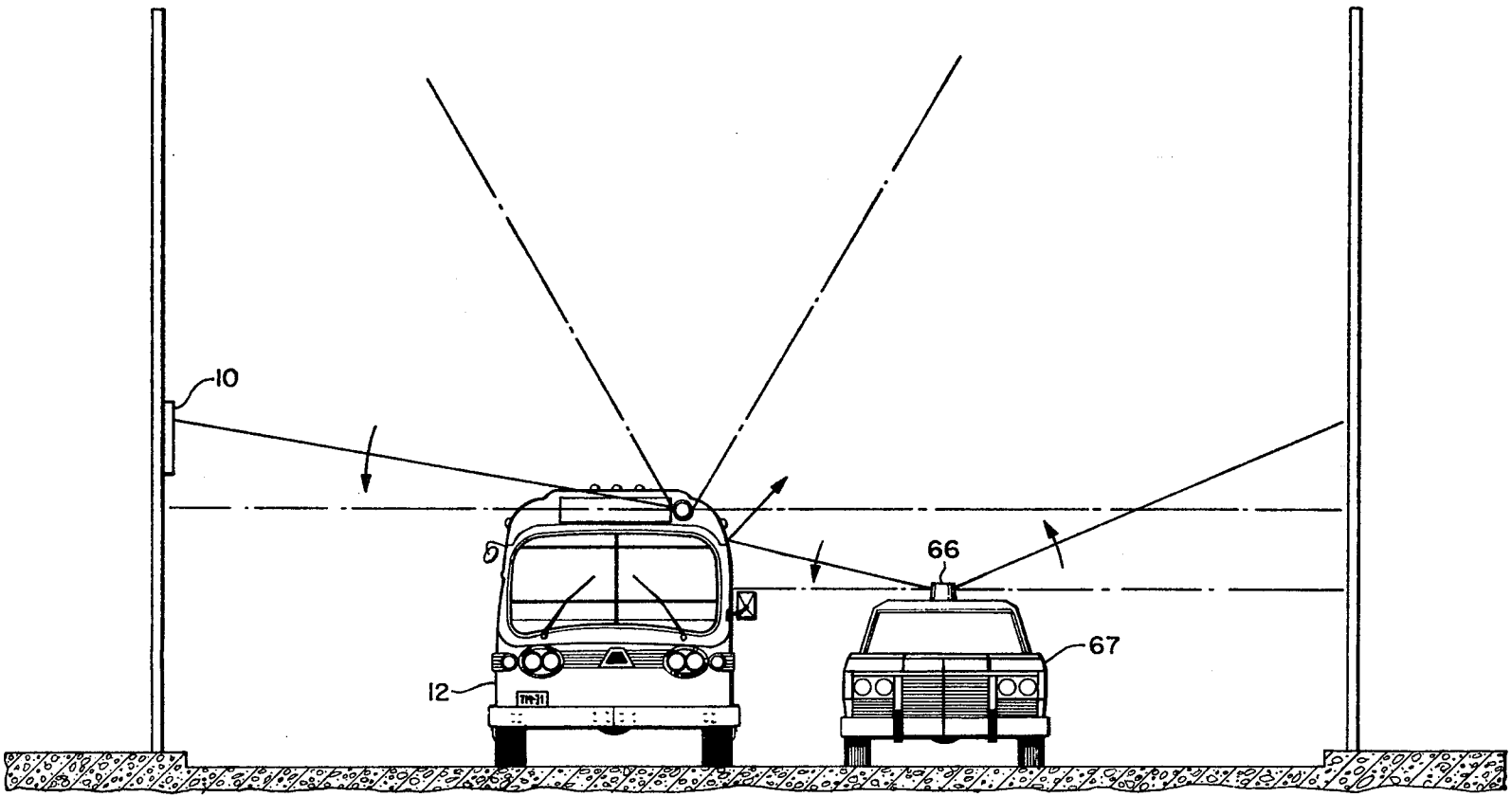
FIG. 6 illustrates a situation wherein a scanning beam is blocked from reading a signpost.

The apparatus as described in FIG. 4 may be standardized for utilization in various types of vehicles. For example, FIG. 6 illustrates a situation wherein the scanning apparatus is contained in housing 66 mounted on top of car 67. FIG. 6 also depicts the situation wherein the right scanning beam of the car's system is blocked from reading signpost 10, however the car's left scanning beam will pick up and detect the next encountered signpost.

Although the double scanning system of the present invention allows for a more accurate vehicle location system the apparatus additionally finds utility in other areas such as the control of unmanned vehicles for maintaining the vehicles along a predetermined path without the benefit of track. By way of example, and with reference to FIG. 7, a plan view of a roadway or pathway 70 is illustrated and along which an unmanned vehicle 72 is to proceed. A plurality of reflective target members 74 are placed along the pathway on either side opposite one another and the opposing target members are read by both a right scanning beam 76R and left scanning beam 76L respectively.

Figure 8:
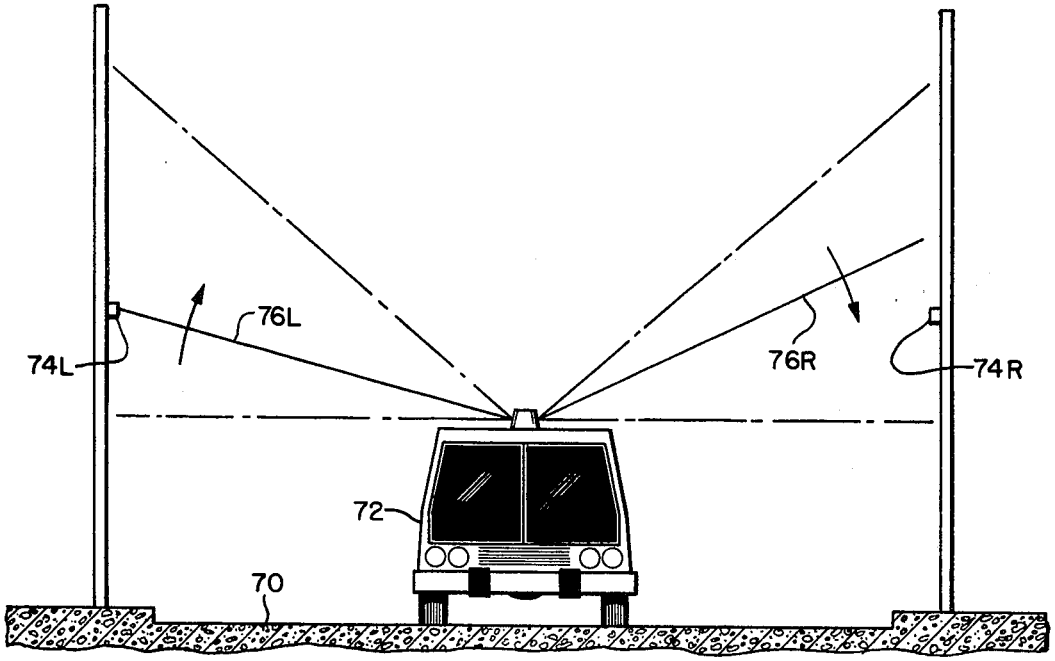
FIG. 8 illustrates the vehicle of FIG. 7 and its scanning of two reflective target members.
Figure 7:
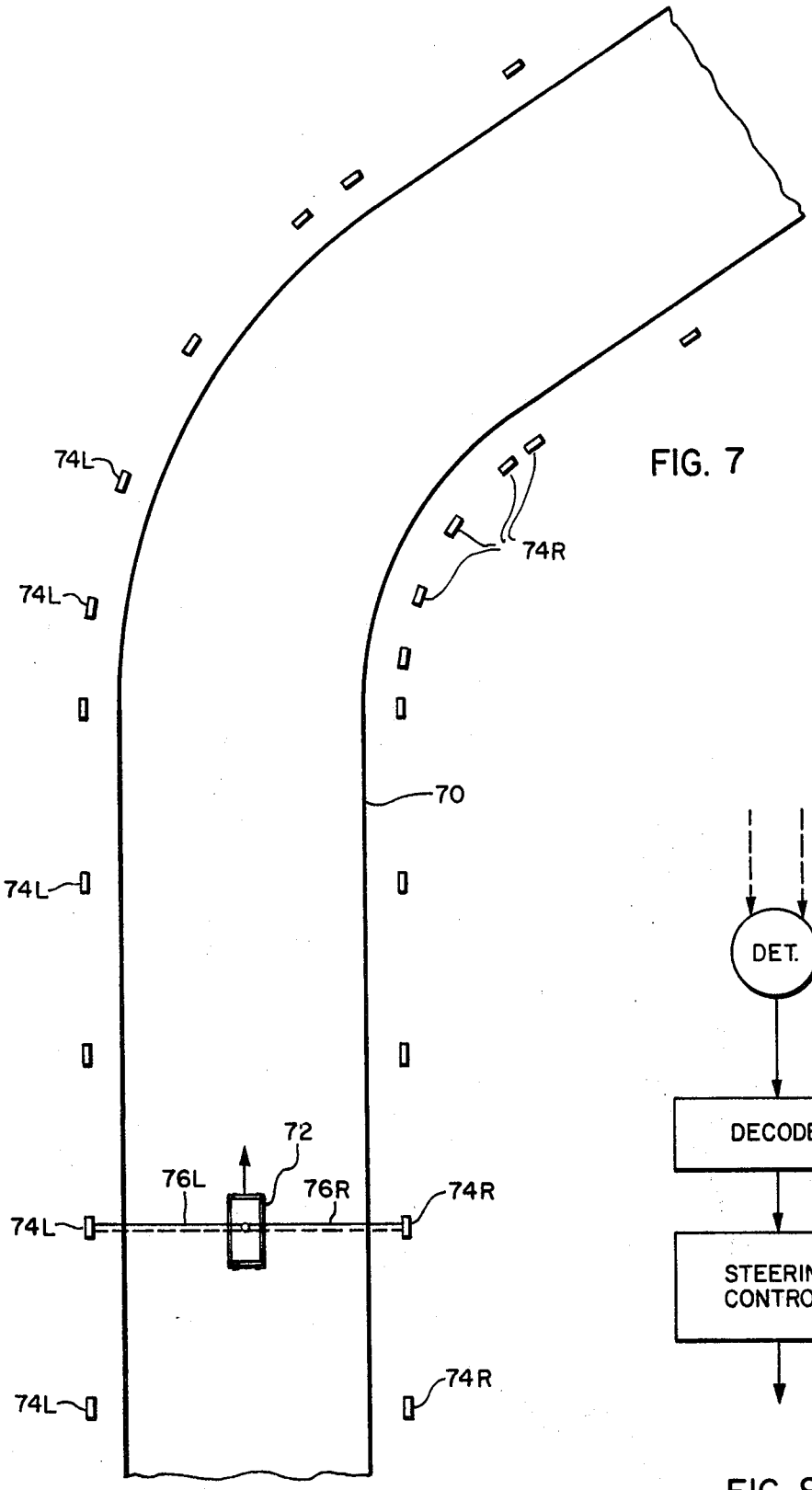
FIG. 7 is a plan view of another embodiment of the present invention wherein a vehicle is maintained along a predetermined path.
Figure 9:
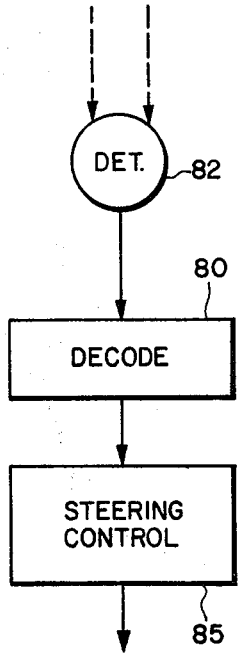
FIG. 9 is a block diagram of apparatus for controlling the vehicle of FIG. 8.

With additional reference to FIG. 8, scanning beam 76L scanning from bottom to top, and scanning beam 76R scanning from top to bottom, will cause respective received signals, the time difference in occurrence of which as well as signal strength and length of signal will be a function of the vehicle's position between the targets. Thus, and as illustrated in FIG. 9, a decode circuit 80 is responsive to the output of detector 82, which receives the right and left return signals, to interpret the time difference of arrival in the signals to provide a control signal to steering control circuit 85 which is operative to maintain the vehicle along a prescribed path. Although FIG. 7 illustrates a plurality of target members disposed along the pathway, with more target members being located in the curved section, a more precisely controlled system may be obtained if the target members were formed of a continuous retroreflective tape for example running the length of the pathway and on either side of it and affixed to some support member such as a wall at a predetermined height. In its basic implementation, the target members need not be coded since all that is required is a return signal from each side for time comparison purposes or for comparing signal strength or length of signal. Stops or other commands however may be designated by a particular coded section.

Accordingly, there has been described a multisided scanning concept that permits scanning both to the right and left sides of the vehicle's path resulting, in the case of vehicle location, in signpost redundancy and consequent reduction of overall position location errors. The system utilizes a network of relatively inexpensive and maintenance free passive coded signposts and one standard scanning arrangement may be applicable to variety of carrier vehicles.

In addition, the system finds utility in the active control of driverless vehicles for maintaining the vehicle along a prescribed path.

I claim:

1. A vehicle control scanning system comprising:

(a) a network of reflective target members disposed along the expected path of said vehicle and on both sides of said path;

(b) vehicle carried optical scanning means for generating scanning optical beams for scanning said target members on both sides of said path during travel of said vehicle;

(c) said scanning means including (i) a light source for providing a single optical beam;

(ii) a rotating mirror having a plurality of facets;

(iii) a mirror system interposed in the path of said optical beam and being constructed and arranged to reflect said beam simultaneously to two different facets of said rotating mirror to provide two simultaneously scanning beams; and (d) vehicle carried detection means positioned for detecting the reflected optical beams from said both sides.

2. Apparatus according to claim 1 wherein;

(a) said beams scan in a substantially vertical direction, one scanning up while the other is scanning down.

3. Apparatus according to claim 2 wherein:

(a) said target members are vertically oriented and include coded retroreflective portions.

4. Apparatus according to claim 1 wherein said mirror system includes:

(a) at least two mirrors, a first of said mirrors being totally reflective and the second being 50% reflective and positioned such that said optical beam reflects from and also passes through said second mirror to said first mirror.

5. Apparatus according to claim 1 wherein:

(a) said detection means includes a single detector and a single signal processor.

6. Apparatus according to claim 1 wherein:

(a) said detection means includes a single detector; and (b) said first and second mirrors are in the path of said reflected optical beams, to direct them to said single detector.

7. Apparatus according to claim 1 wherein:

(a) said target members are disposed opposite one another along said path.

8. Apparatus according to claim 7 wherein:

(a) said target members are at the same height above the vehicle roadway.

9. Apparatus according to claim 7 which includes:

(a) means responsive to the detected reflected optical beams for generating a control signal to govern the position of said vehicle between said oppositely disposed target members.

* * * * *